US007733293B2

(12) United States Patent
Imai

(10) Patent No.: US 7,733,293 B2
(45) Date of Patent: Jun. 8, 2010

(54) ANTENNA FOR REMOTE CONTROLLED TOY, ANTENNA CAP AND REMOTE CONTROLLED TOY

(75) Inventor: Nobuo Imai, Tokyo (JP)

(73) Assignee: Nikko Co., Ltd., Tokyo (JP)

( * ) Notice: Subject to any disclaimer, the term of this patent is extended or adjusted under 35 U.S.C. 154(b) by 553 days.

(21) Appl. No.: 11/806,389

(22) Filed: May 31, 2007

(65) Prior Publication Data

US 2007/0279297 A1 Dec. 6, 2007

(30) Foreign Application Priority Data

May 31, 2006 (JP) ..... 2006-152924

(51) Int. Cl.
*H01Q 1/10* (2006.01)

(52) U.S. Cl. ..... 343/901; 343/715; 343/895; 343/906

(58) Field of Classification Search ..... 343/713, 343/715, 900, 901, 906, 895; 446/456
See application file for complete search history.

(56) References Cited

U.S. PATENT DOCUMENTS 5,701,129 A * 12/1997 Itou et al. ..... 343/873
6,215,451 B1 * 4/2001 Hadzoglou ..... 343/715
6,348,896 B2 * 2/2002 Takagi et al. ..... 343/702
6,529,139 B1 * 3/2003 Behun et al. ..... 340/825.69
2006/0293102 A1 * 12/2006 Kelsey ..... 463/37

FOREIGN PATENT DOCUMENTS

JP 59-808 1/1984
JP 2001-061192 3/2001

* cited by examiner

*Primary Examiner*—Douglas W Owens
*Assistant Examiner*—Dieu Hien T Duong
(74) *Attorney, Agent, or Firm*—Pillsbury Winthrop Shaw Pittman, LLP

(57) ABSTRACT

An antenna for a remote controlled toy comprises a conductor made of a metal wire and a cap portion anchored in an end of the conductor, wherein said conductor has a hook portion with a U-shaped end, a first flared portion articulated with said hook portion and provided crookedly for projecting in the perpendicular direction to said hook portion, a second flared portion articulated with the first flared portion and provided crookedly for projecting in the opposite direction from said first flared portion with regard to said hook portion, said cap portion has a T-shaped groove comprised of a horizontal groove housing said first flared portion and said second flared portion, a perpendicular groove housing said hook portion, and a hook locking part is provided inside the T-shaped groove.

6 Claims, 3 Drawing Sheets

ANTENNA FOR REMOTE CONTROLLED TOY, ANTENNA CAP AND REMOTE CONTROLLED TOY

This application claims the benefit of priority of Japanese Patent Application No. 2006-152924, filed May 31, 2006, the entire contents of which are incorporated herein by reference.

BACKGROUND OF THE INVENTION

1. Field of the Invention

The present invention relates to an antenna for a remote controlled toy, an antenna cap and a remote controlled toy, in particular, to an antenna, an antenna cap and a remote controlled toy capable of being anchored only by insertion of an antenna and an antenna cap, which have further definite strength.

2. Description of Related Art

The conventional remote controlled toy adopts an antenna cap which is formed with a thermo-plastics and provided with a flat elongated insertion hole opening on the lower face, wherein the point of the antenna heated to the necessary temperature is inserted into said insertion hole so that the point is rotated for mounting with the antenna cap integrally by means of thermal welding.

There are, however, some problems, for example, necessity of skills for mounting operation, weak coupling and low efficiency of mounting operation. Japanese laid-open utility model publication No. 59-808, therefore, proposes an antenna cap anchored by a pin hole and loop portion.

BRIEF DESCRIPTION OF THE DRAWINGS

The above and other objects, features, and advantages of the present invention will be made more apparent from the description of preferred embodiments with reference to the accompanying drawings wherein:

FIG. 2(*b*) shows a top view of a conductor 4 of an antenna for a remote controlled toy;

FIG. 2(*c*) shows a top view of a hook portion with a 0-degree inclined angle.

FIG. 3(*b*) shows a cross-sectional view of FIG. 3(*a*) taken along the line B-B.

FIG. 4(*b*) shows a cross-sectional view of FIG. 4(*a*) taken along the line B-B.

FIG. 5(*b*) is a remote controlled toy according to the present invention applied to the controller of the remote controlled toy.

DETAILED DESCRIPTION OF THE INVENTION

Figure 1:
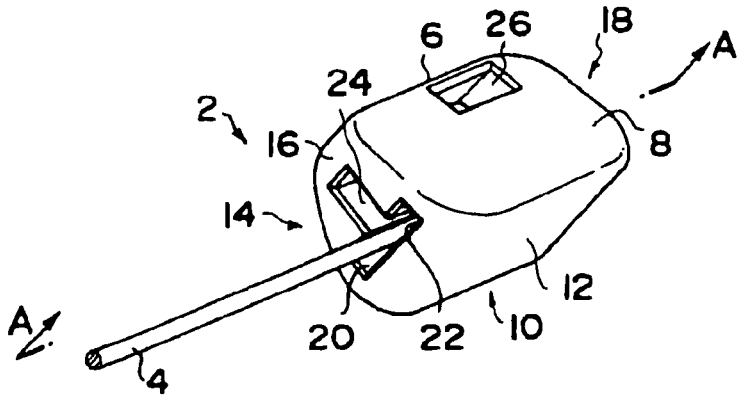
FIG. 1 is a projection view of an antenna for a remote controlled toy according to the invention.

There are, however, two problems in the antenna cap described. Firstly, according to the method described due to plastic deformation of pin 4 by a pressing machine for production, devices including a pressing machine are necessary and it is not easy to produce.

Secondly, as to strength, sufficient durability in tensile test with 10 kg was not achieved, thus the strength was not sufficient.

An aspect of certain embodiments of the present invention is, therefore, to provide an antenna for a remote controlled toy, an antenna cap and a remote controlled toy, in particular, an antenna, an antenna cap and remote controlled toy capable of being anchored only by insertion of an antenna and an antenna cap, which have definite strength.

A first aspect of certain embodiments in accordance with the present invention is directed to an antenna for a remote controlled toy which comprises a conductor made of a metal wire and a cap portion anchored in an end of the conductor, wherein said conductor has a hook portion with a U-shaped end, a first flared portion articulated with said hook portion and provided crookedly for projecting in the perpendicular direction to said hook portion, a second flared portion articulated with the first flared portion and provided crookedly for projecting in the opposite direction from said first flared portion with regard to said hook portion, said cap portion has a T-shaped groove comprised of a horizontal groove housing said first flared portion and said second flared portion, a perpendicular groove housing said hook portion, and a hook locking part is provided inside the T-shaped groove.

The antenna for the remote controlled toy may be antennas for remote controlled toys, such as an automobile, a motorbike, a ship, a airplane and a tank, and antennas for controllers for remote control.

The point of said hook portion may have a predetermined angle with regard to said conductor.

Said cap portion may also provide with a continuous hole communicating the perpendicular groove.

A second aspect of certain embodiments in accordance with the present invention is further directed to an antenna cap for a remote controlled toy which comprises a hook portion with a U-shaped end, a conductor having a first flared portion articulated with said hook portion and provided crookedly for projecting in the perpendicular direction to said hook portion and a second flared portion articulated with the first flared portion and provided crookedly for projecting in the opposite direction from said first flared portion with regard to said hook portion, a T-shaped groove which comprises a horizontal groove housing said first flared portion and said second flared portion, and a perpendicular groove housing said hook portion in order to insert said conductor into the groove for locking, and a hook locking part is provided inside the T-shaped groove.

A continuous hole communicating the perpendicular groove is further provided.

In addition, a third aspect of certain embodiments in accordance with the present invention is directed to a remote controlled toy which is provided with an antenna comprising a conductor made of a metal wire as an aerial wire and a cap portion anchored in an end of the conductor, wherein said conductor has a hook portion with a U-shaped end, a first flared portion articulated with said hook portion and provided crookedly for projecting in the perpendicular direction to said hook portion, a second flared portion articulated with the first flared portion and provided crookedly for projecting in the opposite direction from said first flared portion with regard to said hook portion, said cap portion has a T-shaped groove comprised of a horizontal groove housing said first flared portion and said second flared portion, and a perpendicular groove housing said hook portion, and a hook locking part is provided inside the T-shaped groove.

By performing an antenna for remote controlled toy, an antenna cap and a remote controlled toy according to the present invention, it is possible, in particular, to be anchored only by inserting the antenna and the antenna cap as well as to have a definite strength.

A typical mode for embodying the invention shall be described in detail with reference to the accompanying drawings.

EMBODIMENTS OF THE INVENTION

A first embodiment of the antenna for remote controlled toy according to the invention shall be illustrated in FIG. 1 of the accompanying drawings. The antenna for remote controlled toy 2 has a conductor 4 made of the metal wire and a cap portion 6 locked on the point of the conductor 4.

The cap portion 6 is covered by longitudinal three-sided faces 8, 10 and 12, wherein an edge face on an aperture 14 is the edge face 16 and an edge face on the top is the edge face 18.

The aperture 14 is a groove, into which the conductor 4 is inserted, and grooves 20, 22 and 24 are cut in T-shape so as to lock the conductor 4.

Moreover, a through hole 26 is provided in side face 8 for passing through the groove 24.

Figure 2:
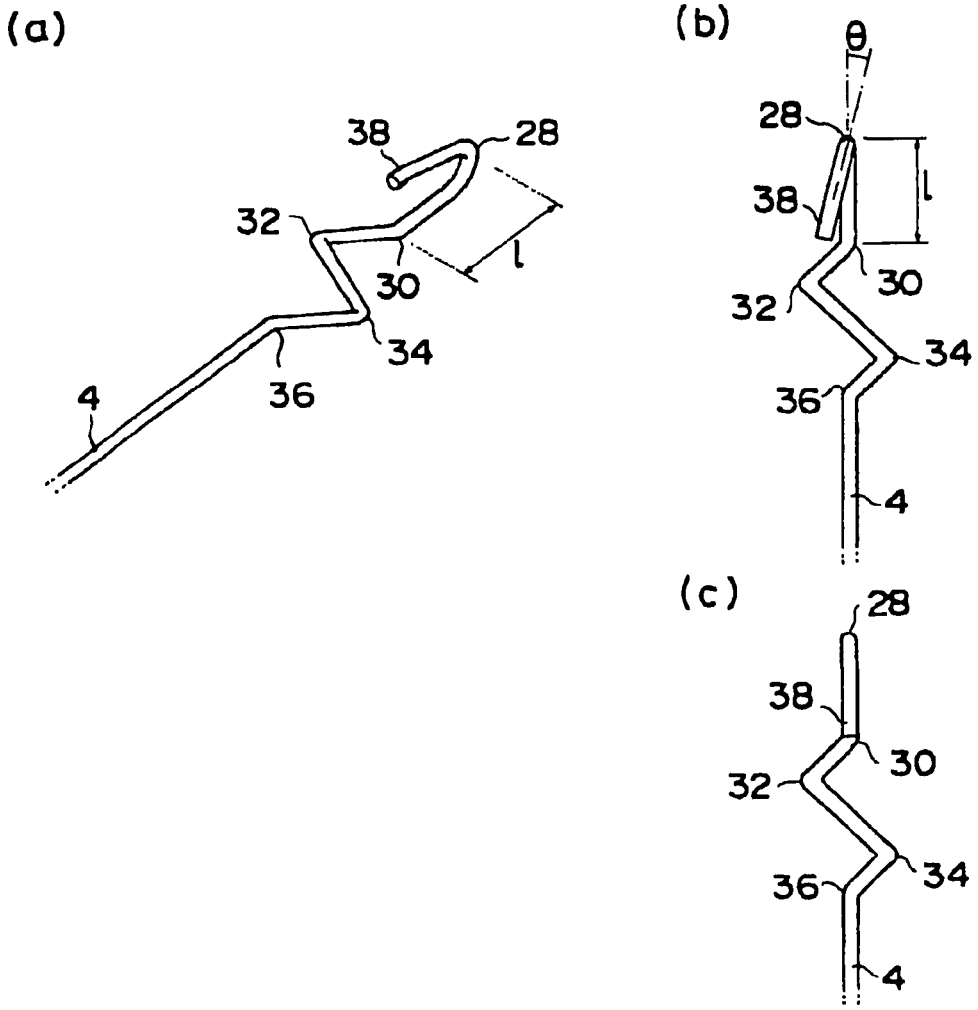
FIG. 2(*a*) shows a projection view of a conductor of an antenna for a remote controlled toy.

The conductor 4 will further be described in detail with reference to FIG. 2 of the accompanying drawings. FIG. 2(*a*) shows a projection view of the conductor, FIG. 2(*b*) shows a top view of the conductor 4, and FIG. 2(*c*) shows a top view of the hook portion with a 0-degree inclined angle. The hook portion 28 configured in U-shape is formed on the end of said conductor 4. Said conductor 4 is articulated with said hook portion 28 and bends at the point 30 so as to project vertically with regard to the plane comprising said hook portion 28. Said conductor 4 further bends at the point 32 so as to project to the other side of point 30 with regard to the plane comprising the hook portion 28 to the point 34, then it bends at point 34 and further bends at the point 36 for extending in a longitudinal direction to the conductor 4.

The end 38 of the hook portion 28 inclines at a predetermine angle θ in a longitudinal direction to the conductor 4. The inclined angle is 1° to 5°. Here, the length from the top portion of the hook portion 28 to the end 38 is defined as 1. In case that the inclined angle is 0°, the configuration of the conductor shall be illustrated in FIG. 2(*c*).

The point 32 of the conductor 4 is inserted into the groove 20 of the cap portion 6, the point 34 of the conductor 4 is inserted into the groove 22 of the cap portion 6, and the hook portion 28 of the conductor 4 is inserted into the groove 24 of the cap portion 6, respectively.

Figure 3:
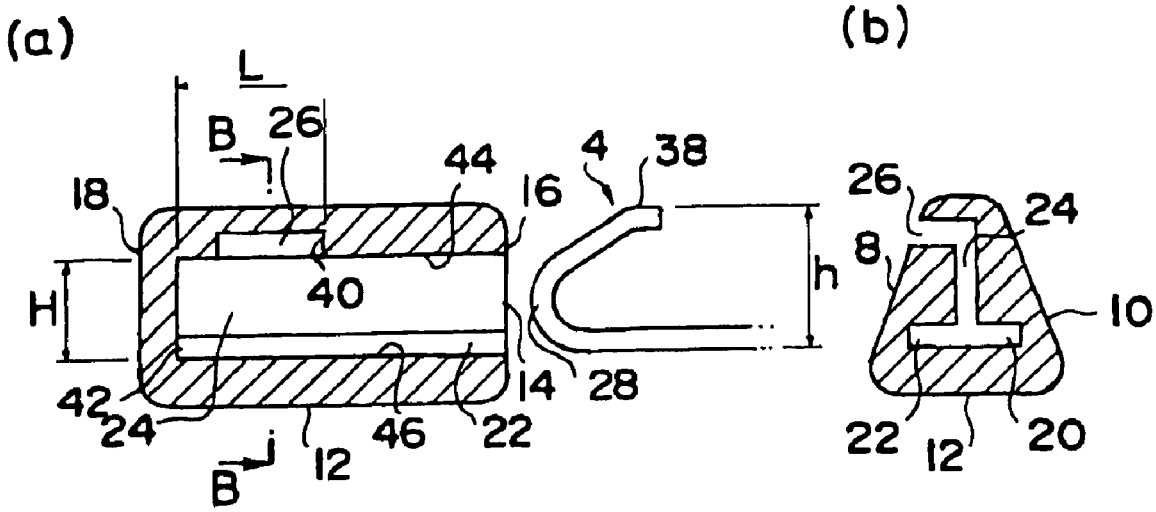
FIG. 3(*a*) shows a cross-sectional view of a cap portion 6 of FIG. 1 taken along the line A-A.

FIG. 3(*a*) will illustrate a cross-sectional view of the cap portion 6 of FIG. 1 taken along the line A-A and FIG. 3(*b*) shows a cross-sectional view of FIG. 3(*a*) taken along the line B-B.

FIG. 3(*a*) shows a cross-sectional view of the cap portion 6 of FIG. 1 taken along the line A-A, grooves 22 and 24 are cut from the end face 16 of the cap portion 6 to the bottom face 42 inside the groove 14 of the cap portion. The length H of the aperture comprised of the groove 24 and the groove 22 is configured to be lower than the outer width h of the hook portion 28 of the conductor 4. This configuration leads to prevent from departure of the hook portion 28.

On the other hand, in the groove 24, the through hole 26, which passes through into the side face 8 in the opposite direction of the groove 22 with regard to the longitudinal axis of the cap portion, is opened. Here, in case that the distance between the inner wall 40 of the through hole positioned at the end face 16 and the bottom face 42 of the groove 24 and 22 is L, it is preferable that said 1 and L are approximately equivalent.

Figure 5:
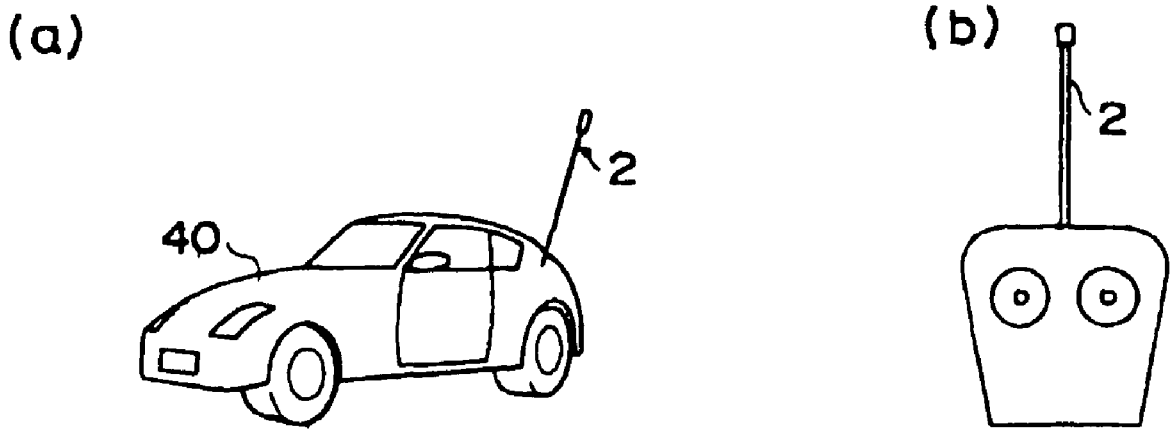
FIG. 5(*a*) is a remote controlled toy according to the present invention applied to the automobile toy.

FIG. 5(*a*) is a drawing applying the invention to an automobile model of a remote controlled toy, and FIG. 5(*b*) is a drawing applying the invention to a controller of a remote controlled toy.

Figure 4:
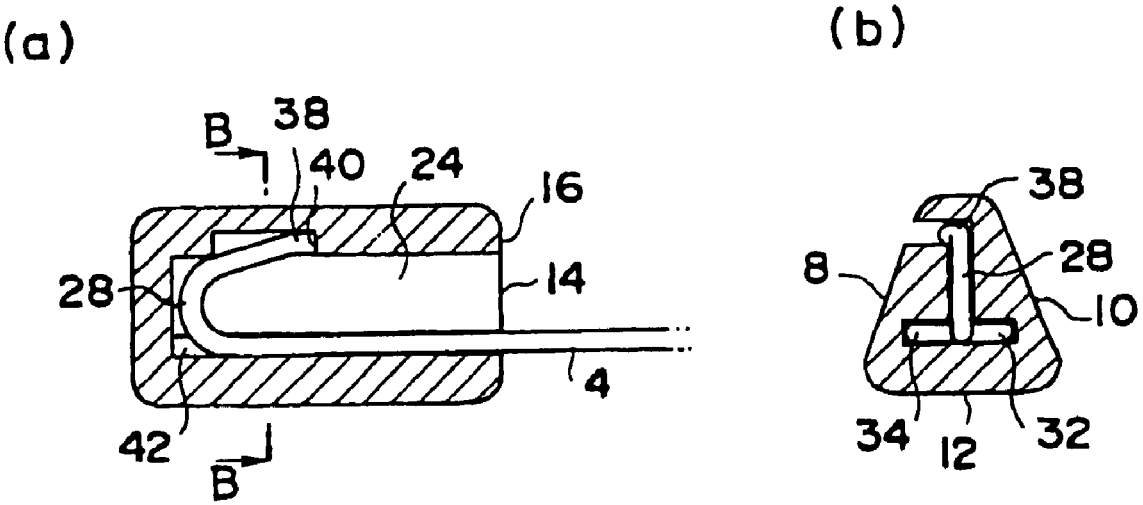
FIG. 4(*a*) shows a cross-sectional view of the cap portion 6 of FIG. 1 taken along the line A-A.

Next, the operation of the antenna 2 of a remote controlled toy according to the invention will be described with reference to FIG. 4.

Firstly, a direction of projection of the hook 28 is arranged so that the point 32 of the conductor 4 corresponds to the groove 20 of the cap portion 6, the point 34 of the conductor 4 corresponds to the groove 22 of the cap portion 6, the hook portion 28 of the conductor 4 corresponds to the groove 24 of the cap portion 6, and the top of the hook portion 28 is inserted into the aperture 14 of the cap portion 6.

Secondly, when the top of the hook portion 28 is inserted into the aperture 14, the U-shaped portion of the hook portion 28 is pressed on the inner wall 4 of the groove 24 of the cap portion 6 and the inner wall 46 of the groove 22 for being inserted into the groove 24 and 22 in compression.

Thirdly, if the end 38 of the hook portion 28 passes through the inner wall 40 of the through hole 26 positioned at the end face 16 so as to expand the space to the height of the though hole 26, thus the compression of the end 38 of the hook portion 28 is released.

Fourthly, this release of the U-shaped potion of the hook portion 28 brings to stretch out the U-shaped portion so that the end 38 is locked with the inner wall 40.

If, compared to the distance L between the inner wall 40 and the bottom face 42 and the length 1 from the top of the hook portion 28 to the end 38, L is shorter than 1, it causes permanent set in fatigue at the hook portion 28, thus the elasticity is vanished and the hook portion 28 becomes unrecoverable, for that reason, it is necessary that L should be equivalent to or larger than 1.

On the other hand, if L is too long, the conductor 4 moves inside the aperture 14, thus it becomes easily disengaged and it is unendurable in tensile test with 10 kg, for that reason, it is preferable that L and 1 are approximately equivalent.

The inclined angle θ of the hook portion may be 0° so as to heighten the penetrability to the T-shaped groove.

An antenna for remote controlled toy, an antenna cap and a remote controlled toy according to the invention are applicable to any antenna for a remote controlled toy.

What is claimed:

1. An antenna for a remote controlled toy comprising a conductor made of a metal wire and a cap portion anchored in an end of the conductor, wherein said conductor has a hook portion with a U-shaped end, a first flared portion articulated with said hook portion and provided crookedly for projecting in the perpendicular direction to said hook portion, a second flared portion articulated with the first flared portion and provided crookedly for projecting in the opposite direction from said first flared portion with regard to said hook portion, said cap portion has a T-shaped groove comprised of a horizontal groove housing said first flared portion and said second flared portion, a perpendicular groove housing said hook portion, and a hook locking part is provided inside the T-shaped groove.

2. The antenna for a remote controlled toy according to claim 1, wherein a point of said hook portion has a predetermined angle with regard to said conductor.

3. The antenna for a remote controlled toy according to claim 1, wherein said cap portion is provided with a continuous hole communicating the perpendicular groove.

4. An antenna cap for a remote controlled toy comprising a hook portion with a U-shaped end, a conductor having a first flared portion articulated with said hook portion and provided crookedly for projecting in the perpendicular direction to said hook portion and a second flared portion articulated with the first flared portion and provided crookedly for projecting in the opposite direction from said first flared portion with regard to said hook portion, a T-shaped groove which comprises a horizontal groove housing said first flared portion and said second flared portion, and a perpendicular groove housing said hook portion in order to insert said conductor into the groove for locking, and a hook locking part is provided inside the T-shaped groove.

5. The antenna cap for a remote controlled toy according to claim 4, wherein a continuous hole communicating the perpendicular groove is further provided.

6. A remote controlled toy provided with an antenna which comprises a conductor made of a metal wire as an aerial wire and a cap portion anchored in an end of the conductor, wherein said conductor has a hook portion with a U-shaped end, a first flared portion articulated with said hook portion and provided crookedly for projecting in the perpendicular direction to said hook portion, a second flared portion articulated with the first flared portion and provided crookedly for projecting in the opposite direction from said first flared portion with regard to said hook portion, said cap portion has a T-shaped groove comprised of a horizontal groove housing said first flared portion and said second flared portion, and a perpendicular groove housing said hook portion, and a hook locking part is provided inside the T-shaped groove.

* * * * *